US010975645B2

(12) United States Patent
Al-Mousa et al.

(10) Patent No.: US 10,975,645 B2
(45) Date of Patent: Apr. 13, 2021

(54) MILLING WELLBORES

(71) Applicant: Saudi Arabian Oil Company, Dhahran (SA)

(72) Inventors: Ahmed Al-Mousa, Dhahran (SA); Marius Neacsu, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 16/192,556

(22) Filed: Nov. 15, 2018

(65) Prior Publication Data

US 2020/0157903 A1 May 21, 2020

(51) Int. Cl.
*E21B 29/00* (2006.01)
*E21B 27/00* (2006.01)
*E21B 37/00* (2006.01)

(52) U.S. Cl.
CPC ..... *E21B 29/002* (2013.01); *E21B 27/00* (2013.01); *E21B 37/00* (2013.01)

(58) Field of Classification Search
CPC ..... E21B 27/00
See application file for complete search history.

(56) References Cited

U.S. PATENT DOCUMENTS 2,638,988 A 5/1953 Williams
2,663,370 A * 12/1953 Donnell ..... E21B 27/005 166/99
2,701,019 A * 2/1955 Steed ..... E21B 27/005 166/99
2,728,599 A 12/1955 Moore
2,751,010 A 6/1956 Trahan
2,915,127 A 12/1959 Abendroth
3,023,810 A 3/1962 Anderson
3,382,925 A 5/1968 Jennings
4,059,155 A * 11/1977 Greer ..... E21B 21/103 166/301
4,296,822 A 10/1981 Ormsby
(Continued)

OTHER PUBLICATIONS

PCT International Search Report and Written Opinion in International Appln. PCT/US2019/061132, dated Feb. 14, 2020, 14 pages.
(Continued)

*Primary Examiner* — Tara Schimpf
*Assistant Examiner* — Dany E Akakpo
(74) *Attorney, Agent, or Firm* — Fish & Richardson P.C.

(57) ABSTRACT

A hollow milling-bit defines a first interior flow passage. A junk catcher sub is connected to the hollow milling-bit and positioned between the hollow milling-bit and the uphole end. A junk recovery tube is connected to the junk catcher sub and positioned between the junk catcher sub and the uphole end. A reverse circulation diverter sub is connected to the junk recovery tube and positioned between the junk recovery tube and the uphole end. The reverse circulation diverter sub includes a ball seat configured to receive a ball. The first recirculation passage fluidically connects the interior flow passage to an outer surface of the tool. The second recirculation passage fluidically connects the interior flow passage to an outer surface of the tool. A catch basket that defines openings is connected to a downhole end of the reverse circulation diverter sub and positioned in the third interior flow passage in-line.

17 Claims, 5 Drawing Sheets

(56) References Cited

U.S. PATENT DOCUMENTS

| | | | | |
|---|---|---|---|---|
| 4,515,212 | A * | 5/1985 | Krugh | E21B 27/00 166/170 |
| 7,188,675 | B2 | 3/2007 | Reynolds | |
| 2002/0053428 | A1 | 5/2002 | Maples | |
| 2010/0270018 | A1 | 10/2010 | Howlett | |
| 2012/0118571 | A1 | 5/2012 | Zhou | |
| 2016/0130914 | A1 * | 5/2016 | Steele | E21B 37/00 166/311 |

OTHER PUBLICATIONS

GCC Examination Report in GCC Appln. No. GC 2019-38640, dated Dec. 30, 2020, 4 pages.

* cited by examiner

MILLING WELLBORES

TECHNICAL FIELD

This discloser relates to forming, cleaning, and completing wellbores.

BACKGROUND

When forming, completing, or working over a wellbore, milling operations are often required. Milling operations involve scraping, cutting, pulverizing, or otherwise removing material from an inner surface of the wellbore. The material removed can include rock, casing, or any other material along the surface of the wellbore.

SUMMARY

This disclosure describes technologies relating to milling wellbores.

An example implementation of the subject matter described within this disclosure is a downhole-type tool with the following features. An uphole end of a downhole-type tool connects to a drill string. A hollow milling-bit is at a downhole end of the downhole-type tool. The hollow milling-bit defines a first interior flow passage. A junk catcher sub is connected to the hollow milling-bit and positioned between the hollow milling-bit and the uphole end. The junk catcher sub defines a second interior flow passage in-line with the first interior flow passage. A junk recovery tube is connected to the junk catcher sub and positioned between the junk catcher sub and the uphole end. The junk recovery tube defines a third interior flow passage in-line with the first interior flow passage and the second interior flow passage. A reverse circulation diverter sub is connected to the junk recovery tube and positioned between the junk recovery tube and the uphole end. The reverse circulation diverter sub includes a ball seat defining a flow passage with a smaller cross-sectional flow area than a diameter of a ball to be received by the ball seat. A first recirculation passage is defined by a housing of the reverse circulation diverter sub. The first recirculation passage fluidically connects the interior flow passage to an outer surface of the downhole-type tool. A second recirculation passage is defined by the housing of the reverse circulation diverter sub. The second recirculation passage fluidically connects the interior flow passage to an outer surface of the downhole-type tool. A catch basket that defines openings is connected to a downhole end of the reverse circulation diverter sub and positioned in the third interior flow passage in-line.

Aspects of the example implementation, which can be combined with the example implementation alone or in combination, include the following. The junk catcher sub includes fingers hingedly attached to an interior surface of the junk catcher sub.

Aspects of the example implementation, which can be combined with the example implementation alone or in combination, include the following. The fingers are spring-loaded fingers. The spring-loaded fingers are biased in a downhole direction.

Aspects of the example implementation, which can be combined with the example implementation alone or in combination, include the following. The first recirculation passage fluidically connects to the interior flow passage at a point uphole of the ball seat.

Aspects of the example implementation, which can be combined with the example implementation alone or in combination, include the following. The second recirculation passage fluidically connects to the interior flow passage at a point downhole of the ball seat.

Aspects of the example implementation, which can be combined with the example implementation alone or in combination, include the following. Centralizers are positioned along an outer surface of the downhole-type tool.

Aspects of the example implementation, which can be combined with the example implementation alone or in combination, include the following. The ball seat is retained at a first position within the reverse circulation diverter sub by a shear pin.

Aspects of the example implementation, which can be combined with the example implementation alone or in combination, include the following. The ball seat is retained at a second position by the catch basket. The ball seat is in the second position after the shear pin has been sheared.

An example implementation of the subject matter described within this disclosure is a method with the following features. A downhole-type milling tool is rotated within a wellbore. Circulation is reversed within the downhole-type milling tool. Reversing circulation includes directing circulation fluid to flow outside of the downhole-type milling tool in a downhole direction, and within the downhole-type milling tool in an uphole direction. Cuttings are received within the downhole-type milling tool in response to the reversed circulation. The cuttings are retained within the downhole-type milling tool. Circulation is returned to normal. Normal circulation includes directing circulation fluid to flow within the downhole-type milling tool in a downhole direction and outside the downhole-type milling tool in an uphole direction.

Aspects of the example implementation, which can be combined with the example implementation alone or in combination, include the following. Reversing circulation includes receiving a ball in a ball seat of the downhole-type milling tool. The ball in the ball seat directing fluid to reverse circulate.

Aspects of the example implementation, which can be combined with the example implementation alone or in combination, include the following. Returning circulation to normal includes increasing a circulation pressure. A shear pin retaining the ball seat in is sheared in response to the increased pressure. The ball seat is moved in response to shearing the shear pin.

Aspects of the example implementation, which can be combined with the example implementation alone or in combination, include the following. Retaining the cuttings within the downhole-type milling tool includes causing an interference with a plurality of fingers extending from an inner surface of the downhole-type milling tool towards a center of the downhole-type milling tool.

Aspects of the example implementation, which can be combined with the example implementation alone or in combination, include the following. The cuttings retained within the downhole-type milling tool are removed from the wellbore.

Aspects of the example implementation, which can be combined with the example implementation alone or in combination, include the following. The downhole-type milling tool is determined to be full of cuttings.

An example implementation of the subject matter described within this disclosure is a wellbore milling system with the following features. A milling tool is positioned at a downhole-end of a drill string. The milling tool includes a hollow milling-bit at a downhole end of the milling tool. The hollow milling-bit defines a first interior flow passage. A junk catcher sub is positioned uphole of the hollow milling-bit. The junk catcher sub defines a second interior flow passage in-line with the first interior flow passage. The junk catcher sub includes fingers hingedly attached to an interior surface of the junk catcher sub. A junk recovery tube is positioned uphole of the junk catcher sub. The junk recovery tube defines a third interior flow passage in-line with the first interior flow passage and the second interior flow passage. A reverse circulation diverter sub is positioned uphole of the junk recovery tube. The reverse circulation diverter sub includes a ball seat defining a flow passage with a smaller cross-sectional flow area than a diameter of a ball to be received by the ball seat. A first recirculation passage is defined by a housing of the reverse circulation diverter sub. The first recirculation passage fluidically connects the interior flow passage, at a point uphole of the ball seat, to an outer surface of the milling tool. A second recirculation passage is defined by the housing of the reverse circulation diverter sub. The second recirculation passage fluidically connects the interior flow passage, at a point downhole of the ball seat, to an outer surface of the milling tool. A catch basket is positioned downhole of the ball seat. The catch basket defines a flow passage fluidically connecting to the third interior flow passage.

Aspects of the example implementation, which can be combined with the example implementation alone or in combination, include the following. The fingers are spring-loaded fingers. The spring-loaded fingers are biased in a downhole direction.

Aspects of the example implementation, which can be combined with the example implementation alone or in combination, include the following. Centralizers are positioned along an outer surface of the milling tool.

Aspects of the example implementation, which can be combined with the example implementation alone or in combination, include the following. The ball seat is retained at a first position within the reverse circulation diverter sub by a shear pin.

Aspects of the example implementation, which can be combined with the example implementation alone or in combination, include the following. The ball seat is retained at a second position by the catch basket. The ball seat is in the second position after the shear pin has been sheared.

Particular implementations of the subject matter described in this specification can be implemented so as to realize one or more of the following advantages. Milling operations can be performed without the need to remove the string from the hole to remove cuttings. The tool can also be used to recover existing free-junk within the wellbore.

The details of one or more implementations of the subject matter described in this specification are set forth in the accompanying drawings and the description. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

When removing material from the sides of a wellbore, cuttings are produced. The cuttings tend to be large, ranging from five millimeters to thirty centimeters in size. Such large cuttings are not easily circulated up the wellbore annulus during operations as a clearance between the wellbore and the milling bit is often smaller than the size of the produced cuttings.

Figure 1:
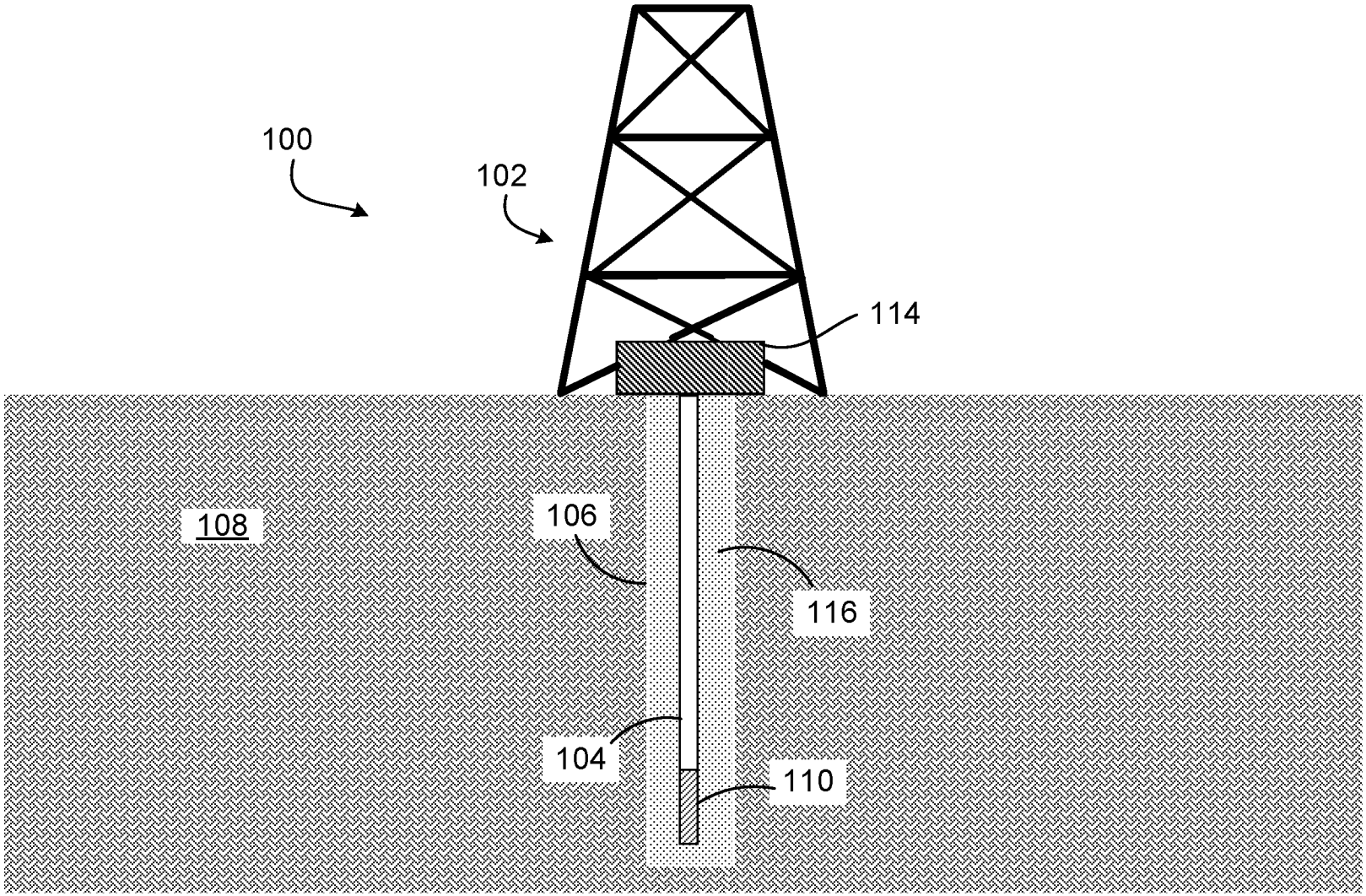
FIG. 1 is a schematic diagram of an example wellsite.

This disclosure relates to a hollow milling tool with a junk basket and a reverse circulation diverter sub. The diverter sub can be ball-activated and causes circulation around the milling tool to reverse when activated. The circulation fluid then flows from the annulus into the hollow mill and up the tool. The fluid carries the milled cuttings into a junk basket defined by a junk recovery tube and a junk catcher sub. The fluid then flows through openings in the diverter sub in an uphole direction, once milling operations are complete, circulation pressure can be increased to shear the ball seat, sending the ball and seat into a receiving basket and filter screen downhole of the diverter sub. Once sheared, the circulation fluid flows in the normal circulation path FIG. 1 is a schematic diagram of an example wellsite 100. The example wellsite includes a derrick 102 that supports a drill string 104 within a wellbore 106. The wellbore 106 is formed within the geologic formation 108. At a downhole end of the drill string 104 is a downhole-type milling tool 110. The downhole-type milling tool 110 can be used to clean, ream, mill, or otherwise adjust the internal diameter of the wellbore 106 or casing within the wellbore 106. At the uphole end of the wellbore 106 is a topside facility 114. The topside facility includes the necessary facilities for wellbore forming operations, such as pumps, compressors, separators, power generators, shaker tables, hoisting equipment, rotating equipment, and any other appropriate equipment for operations within the wellbore. While illustrated as a vertical wellbore, wellbore 106 can be a deviated or horizontal wellbore without departing from this disclosure.

Figure 2:
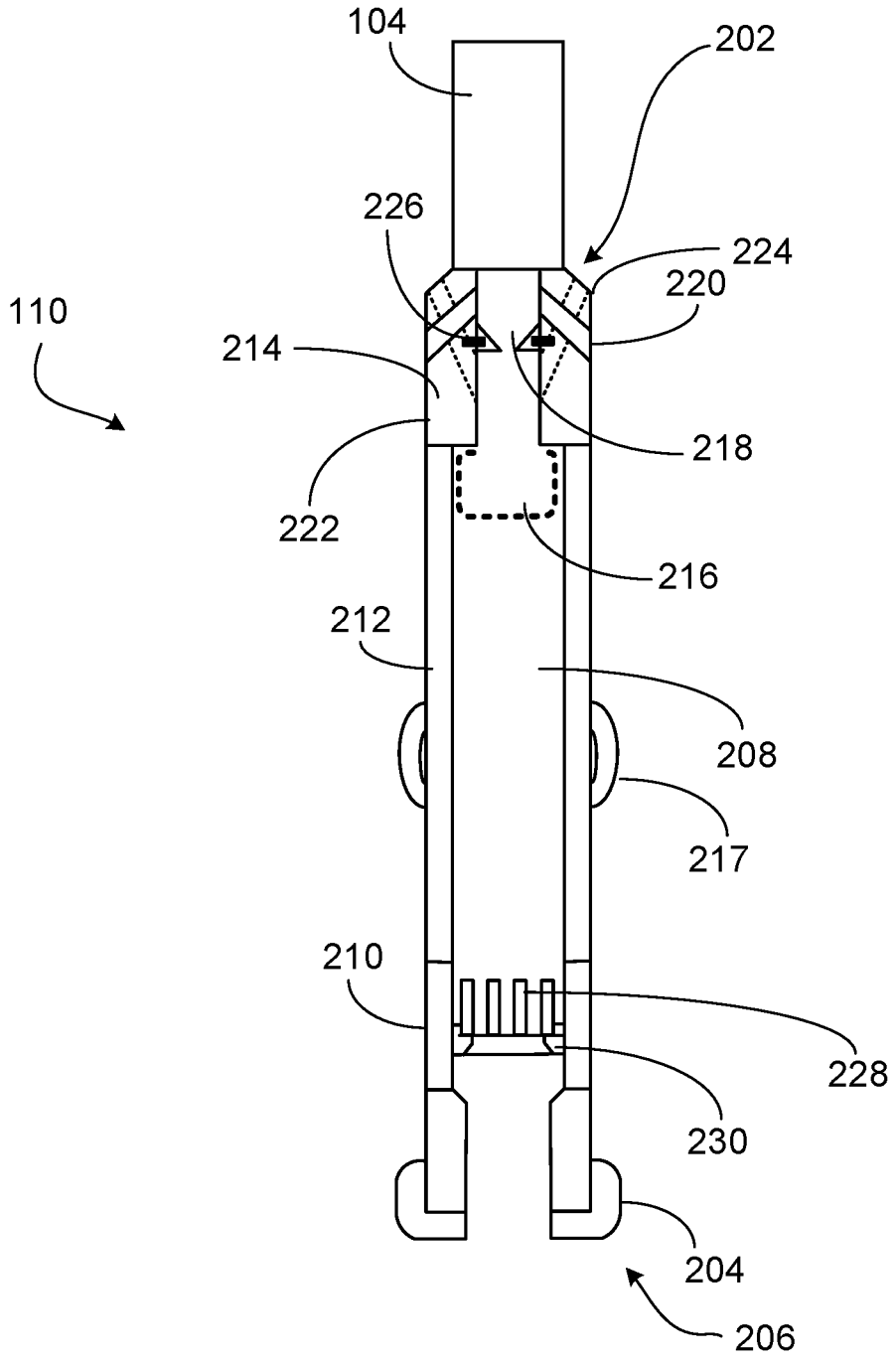
FIG. 2 is a side cross-sectional view of an example downhole-type milling tool that can be used with aspects of this disclosure.

FIG. 2 is a side cross-sectional view of an example downhole-type milling tool 110 that can be used with aspects of this disclosure. The downhole-type milling tool 110 includes an uphole end 202 that connects to the drill string 104. A hollow milling-bit 204 is positioned at a downhole end 206 of the downhole-type milling tool 110. The hollow milling-bit defines an interior flow passage 208. A junk catcher sub 210 is connected to the hollow milling-bit 204 and is positioned between the hollow milling-bit 204 and the uphole end 202. The junk catcher sub 210 further defines the interior flow passage 208. A junk recovery tube 212 is connected to the junk catcher sub 210 and is positioned between the junk catcher sub 210 and the uphole end 202. The junk recovery tube 212 further defines the interior flow passage 208. A reverse circulation diverter sub 214 is connected to the junk recovery tube 212 and is positioned between the junk recovery tube 212 and the uphole end 202. The junk recovery tube 212 is sized such that the junk recovery tube can retain the desired amount of cuttings. For example, the junk recovery tube 212 can range from thirty to forty feet in length. A catch basket 216 that defines multiple openings and is connected to a downhole end of the reverse circulation diverter sub 214 is positioned in the interior flow passage 208. The catch basket 216 is configured to catch a ball seat 218 and a ball during operations (described later within this disclosure). The downhole-type milling tool 110, as illustrated, includes centralizers 217 along an outer surface of the downhole-type milling tool 110. The centralizers maintain the radial position of the downhole-type milling tool 110 radially within the wellbore.

The reverse circulation diverter sub 214 includes a ball seat 218 defining a flow passage with a smaller cross-sectional flow area than a diameter of a ball (not shown) to be received by the ball seat 218. A first recirculation passage 220 defined by a housing 222 of the reverse circulation diverter sub 214 fluidically connects the interior flow passage 208 to an outer surface of the downhole-type milling tool 110. In the illustrated example, the first recirculation passage 220 fluidically connects to the interior flow passage 208 at a point uphole of the ball seat 218. This fluid passage allows fluid to be redirected around the ball (not shown) once the ball is received by the ball seat 218. A second recirculation passage 224 is defined by the housing 222 of the reverse circulation diverter sub 214. The second recirculation passage 224 fluidically connects the interior flow passage 208 to an outer surface of the downhole-type milling tool 110. As illustrated, the second recirculation passage 224 fluidically connects to the interior flow passage 208 at a point downhole of the ball seat 218. This fluid passage allows fluid to be redirected around the ball (not shown) once the ball is received by the ball seat 218.

The ball seat 218 is retained at a first position within the reverse circulation diverter sub 214 by one or more shear pins 226. The one or more shear pins 226 have sufficient dimensions and strength to support the ball seat 218 during circulation operations and a ball supported by the ball seat 218 during circulation operations with a standard specified pressure, for example, 1500 pounds per square inch. During operation, circulation is increased to a level sufficient to shear the one or more shear pins 226, for example, 2500 pounds per square inch. Once the shear pins have been sheared, the ball seat is retained at a second position by the catch basket 216.

The junk catcher sub 210 is downhole of the reverse circulation diverter sub 214 and includes fingers 228 hingedly attached to an interior surface of the junk catcher sub 210. In some implementations, the fingers 228 are spring-loaded fingers that are biased in a downhole direction. Spring-loaded fingers can include separate springs, or can be cantilevered and act as springs themselves. In some implementations, a shoulder 230 can be present. The shoulder creates an interference preventing the fingers 228 from pivoting to a point where the distal ends of the fingers point in a downhole direction. While illustrated as including a single junk catcher sub 210 and a single junk recovery tube 212, multiple junk catchers, junk recovery tubes, or both, can be stacked atop one another in series to increase the cutting carrying capacity of the downhole-type milling tool 110.

Figure 3C:
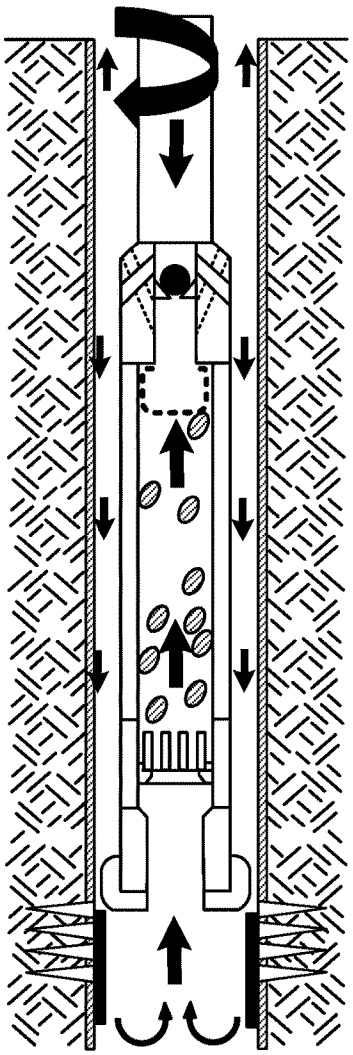
FIGS. 3A-3E are side cross-sectional views of the example downhole-type milling tool in various stages of operation within a wellbore.
Figure 3B:
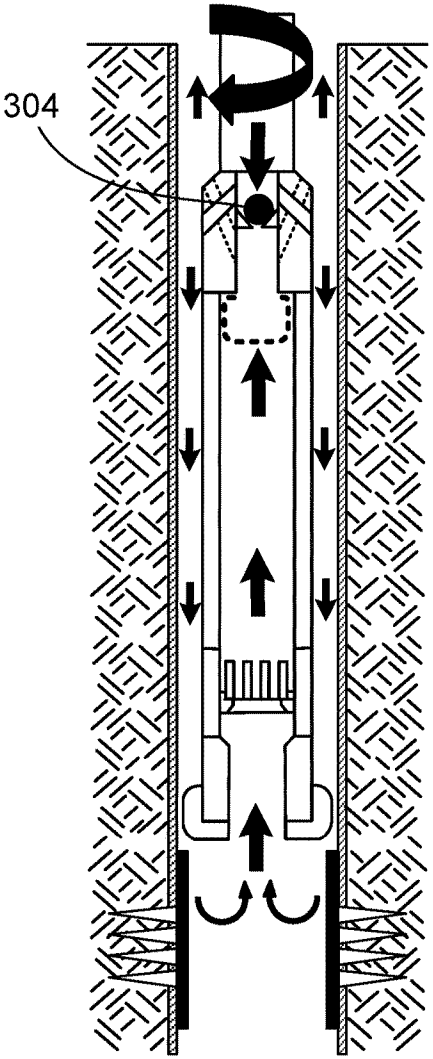
Figure 3A:
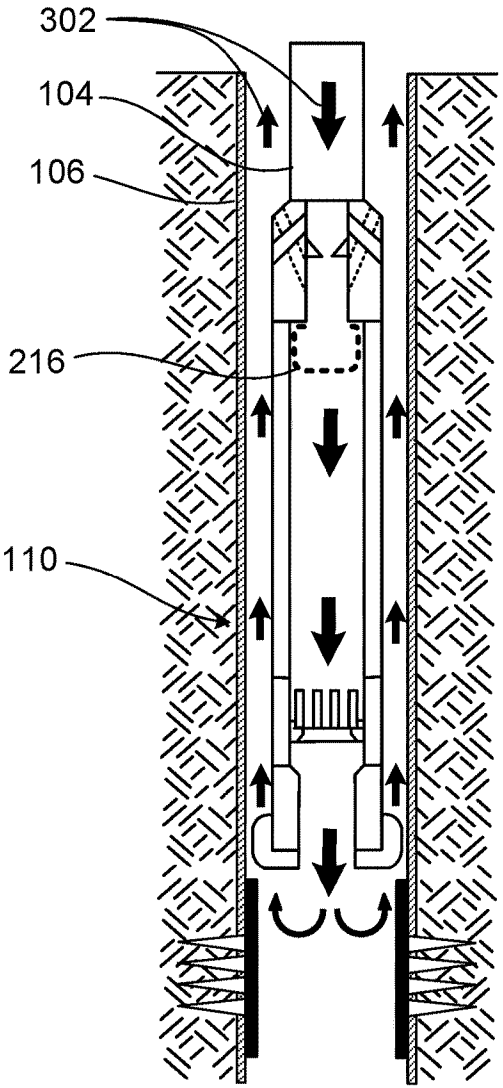

FIGS. 3A-3E are side cross-sectional views of the example downhole-type milling tool in various stages of use within a wellbore. In FIG. 3A, the downhole-type milling tool 110 within the wellbore 106 has circulation fluid 302 flowing through the drill string 104 and through the downhole-type milling tool 110 in a downhole direction. The fluid then circulates from the downhole end 206 of the downhole-type milling tool, and up an annulus of the wellbore that is defined by the outer surface of the downhole-type milling tool 110 and the wellbore 106.

In FIG. 3B, a ball 304 is dropped down the drill string 104 and is received by the ball seat 218 (FIG. 2). The ball 304 blocks the flow of the recirculation fluid out the downhole end 206 (FIG. 2) of the downhole-type milling tool 110. The circulation fluid is then directed through the first recirculation passage 220 and through the annulus in a downhole direction (FIG. 3B). The circulation fluid 302 then flows into the downhole-type milling tool 110 in an uphole direction. As fluid flows into the downhole-type milling tool 110, as shown in FIG. 3C, the circulation fluid 302 can carry cuttings 306, portions of the wellbore that have been removed by the downhole-type milling tool 110, into the downhole-type milling tool 110. The cuttings 306 are retained within the junk recovery tube 212 by the fingers 228. The cuttings 306 are retained within the junk recovery tube 212 by the catch basket 216. The catch basket 216 has enough holes of a small enough size to prevent larger cuttings 306 from continuing in an uphole direction, but allowing the circulation fluid 302 to flow in the uphole direction. Cuttings 306 from milling operations can range from five millimeters to thirty centimeters in size. The circulation fluid 302 then flows out the second recirculation passage 224 and up an annulus of the drill string 104 defined by the outer surface of the drill string 104 and the inner surface of the wellbore 106.

Figure 3E:
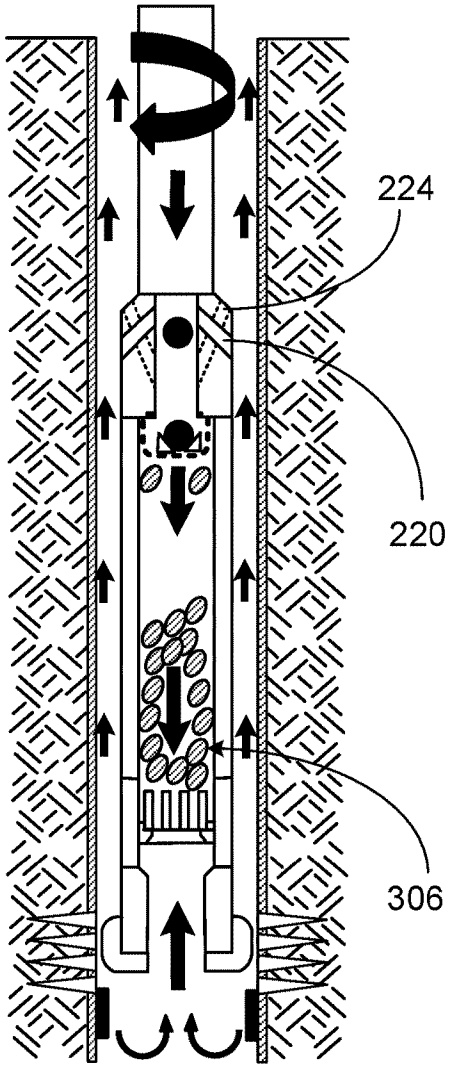
Figure 3D:
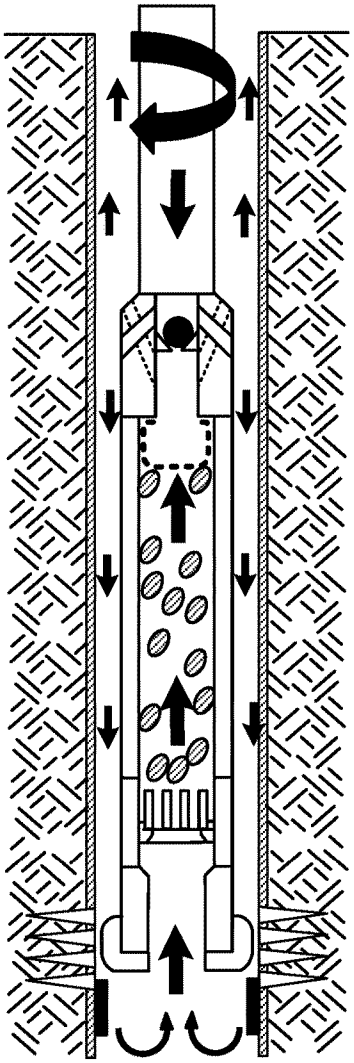

Once the junk recovery tube 212 is full, as shown in FIG. 3D, milling operations are completed, a pressure of the circulation fluid 302 is increased or both. During operation, a surface circulation pressure is monitored. An increase in the surface pressure combined with milling progress, and a length of the recovery tube 212, can be used to determine when the junk recovery tube is full. The increased circulation pressure increases the stress on the one or more shear pins 226 and causes them to shear, releasing the ball seat 218. The ball seat 218 is received by catch basket 216 after the one or more shear pins 226 (FIG. 2) are sheared. As illustrated in FIG. 3E, the release of the ball 304 and ball seat 218 allows the circulation fluid to flow through the downhole-type milling tool 110, past the ball 304 and ball seat 218, through the catch basket 216, and out the downhole end 206 of the downhole-type milling tool 110. Cuttings that are present within the junk recovery tube 212 are retained by the fingers 228 of the junk catcher sub 210.

Figure 4:
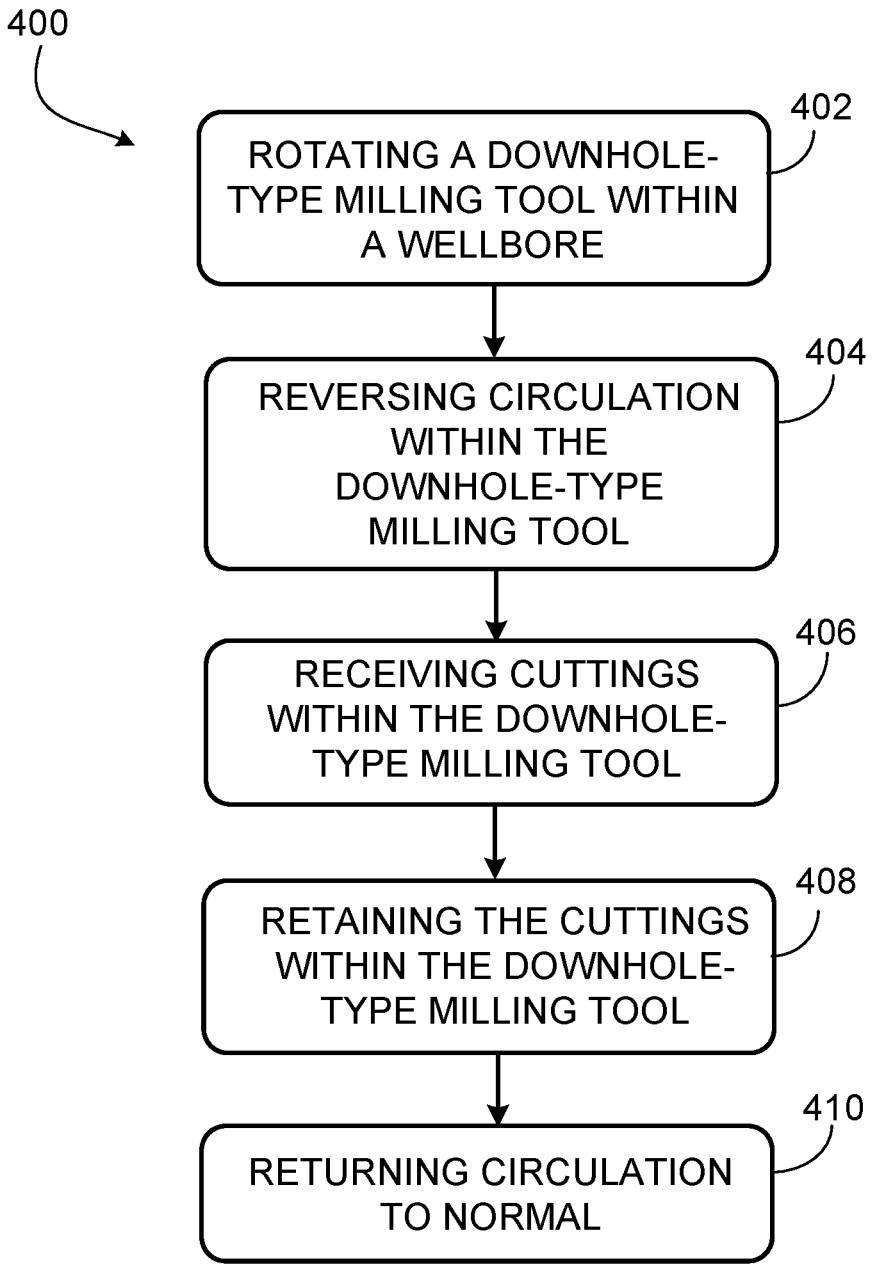
FIG. 4 is a flowchart of an example method that can be used with aspects of this disclosure.

FIG. 4 is a flowchart of an example method 400 that can be used with aspects of this disclosure. At 402 a downhole-type milling tool is rotated within a wellbore. At 404, circulation is reversed within the downhole-type milling tool. Reversing circulation, in the context of this disclosure, includes directing circulation fluid to flow outside of the downhole-type milling tool in a downhole direction, and within the downhole-type milling tool in an uphole direction. In some implementations, reversing circulation includes receiving a ball in a ball seat of the downhole-type milling tool. The ball positioned in the ball seat directs fluid to reverse circulate.

At 406, cuttings are received within the downhole-type milling tool in response to the reversed circulation. At 408, the cuttings are retained within the downhole-type milling tool. Retaining the cuttings within the downhole-type milling tool includes causing an interference with multiple fingers extending from an inner surface of the downhole-type milling tool towards a center of the downhole-type milling tool.

At 410, circulation is returned to normal. Normal circulation, in the context of this disclosure, includes directing circulation fluid to flow within the downhole-type milling tool in a downhole direction, and outside the downhole-type milling tool in an uphole direction. Returning circulation to normal can include increasing a circulation pressure. In response to the increased pressure, a shear pin retaining the ball seat is sheared. The ball seat moves in response to shearing the shear pin.

In some implementations, the method 400 can include determining when the downhole-type milling tool is full of cuttings. During operation, a surface circulation pressure is monitored. An increase in the surface pressure combined with milling progress, and a length of the recovery tube 212, can be used to determine when the junk recovery tube is full. The cuttings, retained within the downhole-type milling tool, are removed from the wellbore with the downhole-type milling tool.

While this specification contains many specific implementation details, these should not be construed as limitations on the scope of what may be claimed, but rather as descriptions of features specific to particular implementations. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may have been previously described as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. Moreover, the separation of various system components in the implementations previously described should not be understood as requiring such separation in all implementations, and it should be understood that the described components and systems can generally be integrated together in a single product or packaged into multiple products.

Thus, particular implementations of the subject matter have been described. Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results. For example, the concepts described herein can be combined with different profiles of the hollow mills or burn shoes for different types of junk. The components of the tools can be assembled together by welding or using screwing with bolts or other fasteners.

What is claimed is:

1. A downhole-type tool comprising:

an uphole end that connects to a drill string;

a hollow milling-bit at a downhole end of the downhole-type tool, the hollow milling-bit defining a first interior flow passage;

a junk catcher sub connected to the hollow milling-bit and positioned between the hollow milling-bit and the uphole end, the junk catcher sub defining a second interior flow passage in-line with the first interior flow passage;

a junk recovery tube connected to the junk catcher sub and positioned between the junk catcher sub and the uphole end, the junk recovery tube defining a third interior flow passage in-line with the first interior flow passage and the second interior flow passage; and a reverse circulation diverter sub connected to the junk recovery tube and positioned between the junk recovery tube and the uphole end, the reverse circulation diverter sub comprising:

a ball seat defining a flow passage with a smaller cross-sectional diameter than a diameter of a ball to be received by the ball seat;

a first recirculation passage defined by a housing of the reverse circulation diverter sub, the first recirculation passage fluidically connecting the flow passage defined by the ball seat to an outer surface of the downhole-type tool;

a second recirculation passage defined by the housing of the reverse circulation diverter sub, the second recirculation passage fluidically connecting the flow passage defined by the ball seat to the outer surface of the downhole-type tool; and a catch basket defining a plurality of openings and fixed to a downhole end of the reverse circulation diverter sub and positioned in the third interior flow passage.

2. The downhole-type tool of claim 1, wherein the junk catcher sub comprises fingers hingedly attached to an interior surface of the junk catcher sub.

3. The downhole-type tool of claim 2, wherein the fingers are spring-loaded fingers, the spring-loaded fingers biased in a downhole direction.

4. The downhole-type tool of claim 1, wherein the first recirculation passage fluidically connects to the first interior flow passage at a point uphole of the ball seat.

5. The downhole-type tool of claim 1, wherein the second recirculation passage fluidically connects to the first interior flow passage at a point downhole of the ball seat.

6. The downhole-type tool of claim 1, further comprising centralizers along the outer surface of the downhole-type tool.

7. The downhole-type tool of claim 1, wherein the ball seat is retained at a first position within the reverse circulation diverter sub by a shear pin.

8. The downhole-type tool of claim 7, wherein the ball seat is retained at a second position by the catch basket, the ball seat being in the second position after the shear pin has been sheared.

9. A method comprising:

rotating a downhole-type milling tool within a wellbore;

reversing circulation within the downhole-type milling tool, wherein reversing circulation comprises directing circulation fluid to flow outside of the downhole-type milling tool in a downhole direction, and within the downhole-type milling tool in an uphole direction, wherein reversing circulation comprises receiving a ball in a ball seat of the downhole-type milling tool, the ball in the ball seat directing fluid to reverse circulate;

receiving cuttings within the downhole-type milling tool in response to the reversed circulation;

retaining the cuttings within the downhole-type milling tool; and returning circulation to normal by the circulation fluid while the downhole-type milling tool remains within the wellbore, wherein normal circulation comprises directing circulation fluid to flow within the downhole-type milling tool in the downhole direction, and outside the downhole-type milling tool in the uphole direction, and wherein returning circulation to normal comprises:

increasing a circulation pressure;

shearing a shear pin retaining the ball seat in response to the increased circulation pressure; and moving the ball seat in response to shearing the shear pin.

10. The method of claim 9, wherein retaining the cuttings within the downhole-type milling tool comprise causing an interference with a plurality of fingers extending from an inner surface of the downhole-type milling tool towards a center of the downhole-type milling tool.

11. The method of claim 9, further comprising removing the cuttings, retained within the downhole-type milling tool, from the wellbore.

12. The method of claim 9, further comprising determining the downhole-type milling tool is full of cuttings.

13. A wellbore milling system comprising:

a drill string;

a milling tool positioned at a downhole-end of the drill string, the milling tool comprising:

a hollow milling-bit at a downhole end of the milling tool, the hollow milling-bit defining a first interior flow passage;

a junk catcher sub positioned uphole of the hollow milling-bit, the junk catcher sub defining a second interior flow passage in-line with the first interior flow passage, the junk catcher sub comprising fingers hingedly attached to an interior surface of the junk catcher sub;

a junk recovery tube positioned uphole of the junk catcher sub, the junk recovery tube defining a third interior flow passage in-line with the first interior flow passage and the second interior flow passage; and a reverse circulation diverter sub positioned uphole of the junk recovery tube, the reverse circulation diverter sub comprising:

a ball seat defining a flow passage with a smaller cross-sectional diameter than a diameter of a ball to be received by the ball seat;

a first recirculation passage defined by a housing of the reverse circulation diverter sub, the first recirculation passage fluidically connecting the flow passage defined by the ball seat, at a point uphole of the ball seat, to an outer surface of the milling tool;

a second recirculation passage defined by the housing of the reverse circulation diverter sub, the second recirculation passage fluidically connecting the flow passage defined by the ball seat, at a point downhole of the ball seat, to the outer surface of the milling tool; and a catch basket positioned downhole of the ball seat, the catch basket defining a flow passage fluidically connecting to the third interior flow passage, fixed to a downhole end of the reverse circulation diverter sub.

14. The wellbore milling system of claim 13, wherein the fingers are spring-loaded fingers, the spring-loaded fingers biased in a downhole direction.

15. The wellbore milling system of claim 13, further comprising centralizers along the outer surface of the milling tool.

16. The wellbore milling system of claim 13, wherein the ball seat is retained at a first position within the reverse circulation diverter sub by a shear pin.

17. The wellbore milling system of claim 16, wherein the ball seat is retained at a second position by the catch basket, the ball seat being in the second position after the shear pin has been sheared.

* * * * *